US011266918B2

(12) United States Patent
Mugnier

(10) Patent No.: US 11,266,918 B2
(45) Date of Patent: Mar. 8, 2022

(54) MOBILE SUBASSEMBLY FOR RECEIVING AND CONVEYING AT LEAST ONE PASSENGER, ASSOCIATED ATTRACTION INSTALLATION AND ITS CONTROL PROCESS

(71) Applicant: POMA, Voreppe (FR)

(72) Inventor: Jean-Francois Mugnier, Voreppe (FR)

(73) Assignee: POMA, Voreppe (FR)

( * ) Notice: Subject to any disclaimer, the term of this patent is extended or adjusted under 35 U.S.C. 154(b) by 0 days.

(21) Appl. No.: 17/172,910

(22) Filed: Feb. 10, 2021

(65) Prior Publication Data

US 2021/0245066 A1 Aug. 12, 2021

(30) Foreign Application Priority Data

Feb. 10, 2020 (FR) ..... 2001281

(51) Int. Cl.
*A63G 27/00* (2006.01)
*A63G 21/00* (2006.01)

(52) U.S. Cl.
CPC ..... *A63G 27/00* (2013.01)

(58) Field of Classification Search
CPC ..... A63G 27/00; A63G 27/02; A63G 21/00; A63G 1/10; A63G 9/16
USPC ..... 472/30, 39, 44, 45
See application file for complete search history.

(56) References Cited

U.S. PATENT DOCUMENTS

| | | | | |
|---|---|---|---|---|
| 8,216,077 | B2 * | 7/2012 | Bussink | A63G 27/00 472/30 |
| 2013/0023350 | A1 | 1/2013 | Morand et al. | |
| 2015/0005082 | A1 * | 1/2015 | Silberman | A63G 27/00 472/45 |

FOREIGN PATENT DOCUMENTS

| | | |
|---|---|---|
| EP | 2 075 043 | 7/2009 |
| JP | 2009 279112 | 12/2009 |
| JP | 2010 005316 | 1/2010 |

OTHER PUBLICATIONS

FR 2001281, dated Oct. 8, 2020, French Search Report.

* cited by examiner

*Primary Examiner* — Kien T Nguyen
(74) *Attorney, Agent, or Firm* — Ray Quinney & Nebeker P.C.; Paul N. Taylor

(57) ABSTRACT

Mobile subassembly (30) to receive and convey at least one passenger, comprising a support (20), a cabin (22) and a cabin (22) guide (32) in relation to the support (20) in rotation around a horizontal reference axis (200). The mobile subassembly (30) is equipped with a stabilization system (36) comprising a gear ring (38), a sprocket (40), a friction brake (82), a reversible permanent magnet synchronous machine (66) to drive the sprocket (40) and a switching circuit (74) which is able, in a first switching state, to link the windings (76) of the synchronous machine (66) to an electricity power supply (78) for motor use of the synchronous machine (66) and, in a second switching state, to link the windings (76) of the synchronous machine (66) to a dissipative ohmic circuit (80) for dissipative use of the synchronous machine (66).

14 Claims, 8 Drawing Sheets

MOBILE SUBASSEMBLY FOR RECEIVING AND CONVEYING AT LEAST ONE PASSENGER, ASSOCIATED ATTRACTION INSTALLATION AND ITS CONTROL PROCESS

TECHNICAL FIELD OF THE INTERVENTION

The invention relates to passenger transport in a cabin according to a trajectory for which the angle in relation to the horizontal is not constant.

STATE OF THE PRIOR ART

Document DE476892 describes an attraction installation comprising a fixed structure, a mobile structure which rotates in relation to the fixed structure around a revolution axis, and spherical cabins supported by the mobile structure so as to turn in relation to the mobile structure around an axis parallel to the revolution axis. The guidance in rotation of each cabin in relation to the mobile structure is provided via a large diameter bearing, which surrounds the cabin, and for which the internal track is attached to the mobile structure and the external track is connected to the cabin. The cabins are ballasted so that their floor remains more or less horizontal when the mobile structure is turning at low speed around the revolution axis. Low oscillation of the cabins around their axis is authorized, and even desired for passengers' amusement.

To stabilize the cabins of a Ferris wheel and to control their rotation around their axis, document JP2010005316 proposes attaching to the fixed internal ring of the bearing a gear ring, for which the teeth are oriented radially inwardly, and installing under the floor in each cabin a motorized system to drive two gear sprockets with the gear ring, each driven by a stabilization motor.

This system must be analyzed from the point of view of its failures modes, which may affect the stabilization motors or their power source in particular. In such cases, the cabin floor may tilt significantly before the Ferris wheel enables an intervention. This then causes undesired unpleasantness for the passengers.

DISCLOSURE OF THE INVENTION

The invention seeks to remedy the disadvantages of the state of the art and to propose a cabin stabilization system which enables the cabin floor to return to a stable position close to horizontal failure in the event of a malfunction of the stabilization motor or its electricity supply.

To do so is proposed, according to a first aspect of the invention, a mobile subassembly to receive and convey at least one passenger, comprising a support, a cabin and a cabin guide in relation to the support in rotation around a reference axis common to the support and the cabin, with the reference axis horizontal when the mobile subassembly is in an operational state, with the mobile subassembly equipped with a stabilization system comprising at least one gear ring connected to the support and centered on the reference axis, at least one sprocket linked to the cabin so as to mesh with the gear ring, a friction brake to stop the cabin rotating around the reference axis in relation to the support, and motorized drive resources which are able to drive the sprocket, characterized in that the motorized drive resources comprise a reversible permanent magnet synchronous machine and a switching circuit which is able, in a first switching state, to link the windings of the synchronous machine to an electricity power supply for motor use of the synchronous machine and, in a second switching state, to link the windings of the synchronous machine to a dissipative ohmic circuit for dissipative use of the synchronous machine. The combined presence of a friction brake and a permanent magnet synchronous machine able to operate in electromagnetic brake enables the implementation of a cabin correction maneuver, following a failure of the motor or its electricity supply. In a first instance, the sprocket may be braked so as to stop the mobile subassembly rotating. Secondly, after the synchronous machine is switched to dissipative mode, the friction brake may be released at least partially and preferably fully and the electromagnetic brake constituted by the synchronous machine to be used for gradual braking while the mobile subassembly returns to its stable position through gravity. Where applicable, the friction brake may be reapplied once the stable position is restored.

Preferably, the switching circuit is monostable and switches or remains in the second switching state if the electricity power supply is disconnected upstream of the switching circuit. According to one embodiment, the switching circuit comprises monostable electromechanical or static contact. The monostable switching of the power circuit ensures that if the power supply fails the stabilization system switches itself to a "gravity" degraded operating mode, in which the synchronous machine acts as an electromagnetic brake.

According to various embodiments, the friction brake may present a friction element connected to a motor shaft of the synchronous machine, the sprocket or gear ring.

According to one embodiment, the friction brake is commanded in all or nothing. Where applicable, the friction brake is a simple parking brake.

Preferably, the friction brake is commanded by a monostable command and is by default, in the absence of command, in closed position. The monostable command of the friction brake comprises preferably an autonomous power source embedded in the cabin, which enables the friction brake to be released even if the synchronous machine's electricity power source is absent.

According to one embodiment, the sprocket is linked to the cabin by a coupling mechanism which is able to guide the sprocket between an engagement position with the gear ring, in which the sprocket is able to mesh with the gear ring by turning around a drive axis parallel to the reference axis, and an uncoupled position in which the sprocket is a distance away and disengaged from the gear ring. The coupling mechanism guides the sprocket between the engagement position and the uncoupled position according to a preferably flat trajectory, which may be a sideways movement, a rotation or a combination of sideways movement and rotation. According to one embodiment, the coupling mechanism is able to guide a sprocket pivot movement around a pivoting axis parallel to the reference axis, between the engagement position and the uncoupled position, with the pivoting axis preferably attached in relation to the cabin. In particular, it may be specified that the coupling mechanism comprises a guide lever which pivots around the pivoting axis and which has a bearing to guide the sprocket in rotation around the drive axis.

Preferably, the coupling mechanism comprises an actuator to move the sprocket from the engagement position to the uncoupled position. The actuator may be of any type, notably electromechanical, hydraulic or pneumatic, and preferably telescopic. Preferably, the actuator is supplied by an autonomous power source embedded in the cabin, which enables the sprocket to be maneuvered, even if the synchronous machine's electricity power supply is disconnected.

The coupling mechanism is preferably bistable. Bistable mechanism means a mechanism with two stable balance positions corresponding to the coupling position and the uncoupled position of the first sprocket, and requiring work by the actuator to move away from either of the stable balance positions to an intermediate unstable balance position.

In practice, the reversible permanent magnet synchronous machine comprises a casing, which is either fixed in relation to the cabin or fixed in relation to the sprocket drive axis. A motor casing fixed in relation to the cabin minimizes the energy needed to move the mobile equipment consisting of the first sprocket. But it requires specific precautions to limit the transmission of vibrations or noise to the cabin. It also requires a transmission mechanism which is able to absorb the positioning variations between the motor casing and the first sprocket, for example a universal joint transmission shaft linking the first motor to the first sprocket. A motor casing fixed in relation to the drive axis of the first sprocket enables a transmission mechanism which absorbs positioning variations to not be used, but where applicable does impose higher power from the actuator. Motor here where applicable also means a geared motor.

According to one particularly advantageous embodiment, the stabilization system comprises at least one additional branch which comprises at least one additional sprocket linked to the cabin so as to mesh with a corresponding gear ring constituted by the gear ring or by an additional gear ring, attached to the support and centered on the reference axis, additional motorized drive resources able to drive the additional sprocket, with the additional motorized drive resources comprising an additional reversible permanent magnet synchronous machine and an additional switching circuit which is able, in a first additional switching state, to link windings of the additional synchronous machine to an electricity power supply for motor use of the additional synchronous machine and, in a second additional switching state, to link the windings of the additional synchronous machine to a dissipative ohmic circuit for dissipative use of the additional synchronous machine. The stabilization system therefore comprises a redundancy which enables the implementation of different degraded operating modes, as well as failure diagnostic procedures.

According to one embodiment, the additional sprocket is linked to the cabin by an additional coupling mechanism so as to move between an engagement position with the corresponding gear ring, in which the additional sprocket is able to mesh with the corresponding gear ring by turning around a drive axis parallel to the reference axis, and an uncoupled position in which the additional sprocket is a distance away and disengaged from the corresponding gear ring. The presence of two mechanisms in particular enables control processing in degraded mode to be considered; these will be discussed further on in this document. The additional coupling mechanism guides the additional sprocket between the engagement position and the uncoupled position according to a trajectory, which may be a sideways movement, a rotation or a combination of sideways movement and rotation. The trajectory follows a flat movement preferably. According to one embodiment, the additional coupling mechanism supports the additional sprocket so that the additional sprocket is able to pivot around a second pivoting axis parallel to the reference axis, between the engagement position and the uncoupled position of the additional coupling mechanism, with the second pivoting axis preferably attached in relation to the cabin. In particular, it may be specified that the additional coupling mechanism comprises a guide lever which pivots around the second pivoting axis and which has a bearing to guide the additional sprocket in rotation around the second drive axis.

Preferably, the additional coupling mechanism comprises an additional actuator to move the additional sprocket from the engagement position to the uncoupled position, with the additional actuator preferably taking support on the cabin. The additional actuator may be of any type, notably electromechanical, hydraulic or pneumatic, and preferably telescopic.

According to one particularly advantageous embodiment, the additional coupling mechanism comprises a bistable transmission between the additional actuator and the additional sprocket, comprising preferably a transmission lever which pivots around an axis which is fixed in relation to the cabin, and a transmission link rod between the additional coupling mechanism transmission and the additional sprocket or the additional actuator.

In practice, the additional synchronous machine comprises a casing, which is either fixed in relation to the cabin or fixed in relation to the additional sprocket drive axis. A motor casing fixed in relation to the cabin minimizes the energy needed to move the mobile equipment consisting of the first sprocket. But it requires specific precautions to limit the transmission of vibrations or noise to the cabin. It also requires a transmission mechanism which is able to absorb the positioning variations between the motor casing and the first sprocket, for example a homokinetic joint or double universal joint transmission shaft linking the first motor to the first sprocket. A motor casing fixed in relation to the drive axis of the first sprocket enables a transmission mechanism which absorbs positioning variations to not be used, but where applicable does impose higher power from the first actuator. Motor here where applicable also means a geared motor.

Preferably, the additional coupling mechanism is independent of the coupling mechanism. This means that each of the two coupling mechanisms of the stabilization system is able to move the corresponding sprocket independently from the position of the other sprocket.

Where applicable, the stabilization system may also comprise a clutch system, to couple each sprocket to the associated motor and to uncouple it from the associated motor.

According to one embodiment, the cabin presents an internal reception volume of at least one passenger. Preferably, the gear ring surrounds the internal reception volume, seen in section perpendicular to the reference axis.

According to one embodiment, the guide comprises at least one bearing attached to the support, a second bearing ring attached to the cabin and bearing bodies able to run on tracks formed on the first bearing ring and the second bearing ring. Preferably, the second bearing ring surrounds the internal reception volume of the cabin.

According to one embodiment, the first sprocket is supported by the cabin so as to mesh with a zone of the gear ring which is located above the first sprocket.

By positioning the first sprocket under the zone of the teeth with which it meshes, the falling by gravity is favored for foreign bodies which may be placed on the teeth, before they reach the meshing zone with the first sprocket.

For this falling effect to be effective, it is preferable that the first sprocket meshes with a zone of the gear ring which is at a sufficient distance from the horizontal plane which contains the reference axis. Preferably, the first drive axis is positioned in relation to an axial reference plane and a first side of the reference axial plane, within an angular sector less than or equal to 60° around the reference axis, with the reference axial plane vertical and containing the rotation axis when the mobile subassembly is in operational state.

According to one embodiment, the first drive axis is positioned within the reference axial plane. This layout will be particularly favorable if the cabin's rotation direction in relation to the support is not always the same.

According to another embodiment, the first drive axis is positioned at a distance from the reference axial plane, on a first side of the reference axial plane. This layout will be particularly favorable once the cabin's rotation direction in relation to the support is always the same, or when there is a favored rotation direction. More specifically, the choice may be made to position the first sprocket on the side of the reference axial plane located downstream of the reference axial plane in the gear ring's rotation direction, or in other words on the side of the reference axial plane, moving away from the zone of the teeth with which the first sprocket meshes. It is therefore ensured that the zone of the teeth with which the first sprocket meshes at a given moment previously crossed the reference axial plane with its teeth directed downwards, which is the most favorable position to ensure the falling of any foreign objects which could have been placed on the teeth.

Where applicable, a gear ring cleaning mechanism is positioned in an angular section of the gear ring located between the zone of the teeth with which the first sprocket meshes and a plane containing the reference axis and horizontal when the mobile subassembly is in operational state. This type of mechanism, which is located preferably before the sprocket in the gear ring's rotation direction, is placed under the tooth zone with which it interacts, to take advantage of gravity which tends to evacuate foreign objects.

According to one embodiment, a meshing obstacle detection mechanism is positioned in an angular section of the gear ring located between the zone of the teeth with which the first sprocket meshes and a plane containing the reference axis and horizontal when the mobile subassembly is in operational state. If the gravity or potential cleaning mechanism prove to be insufficient to clear a foreign object which is trapped in the grease on the toothed surface of the ring, the obstacle detection mechanism enables the mobile subassembly to be stopped before the foreign object which constitutes the obstacle actually comes into contact with the sprocket.

Preferentially, the cabin has a center of gravity which is located within a reference axial plane of the cabin, perpendicular to the floor and containing the reference axis. This is desirable to limit the energy needed to keep the floor horizontal with the stabilization system.

Preferentially, the cabin's center of gravity is located under the reference axis. A degraded operating mode may therefore be provided for, in which the stabilization system is uncoupled or enables the first sprocket to turn freely, with an approximately horizontal level preserved thanks to gravity.

According to a preferred embodiment, the gear ring presents teeth turned towards the reference axis. Preferentially, the first sprocket is positioned above a ceiling inside the cabin. A compartment is then placed below the floor, in which stabilization ballast may be placed. According to one particularly advantageous embodiment, a cabin cooling, heating or air conditioning unit is positioned under the floor inside the cabin. Due to its weight, this type of unit constitutes stabilization ballast.

According to an alternative embodiment, the gear ring presents teeth turned radially towards the exterior, with the first sprocket positioned below the cabin floor.

According to another embodiment of the invention, this is linked to a mobile subassembly which receives and conveys at least one passenger, comprising a support, a cabin and a cabin guide in relation to the support in rotation around a reference axis common to the support and the cabin, with the reference axis horizontal when the mobile subassembly is in an operational state, with the mobile subassembly equipped with a stabilization system comprising at least one gear ring attached to the support and centered on the reference axis, at least one sprocket linked to the cabin so as to mesh with the gear ring, first motorized drive resources able to drive the sprocket, comprising a motor with a motor shaft which turns round a fixed axis in relation to the cabin and a kinematic transmission chain between the motor shaft and the sprocket, characterized in that the stabilization system comprises a coupling mechanism which is able to guide the sprocket between an engagement position with the first gear ring turning around a drive axis parallel to the reference axis and an uncoupled position in which the first sprocket is a distance away and disengaged from the first gear ring, with the kinetic transmission chain comprising a transmission joint. This type of coupling mechanism provides the advantage that it can be actuated easily and visibly from the engagement position to the uncoupled position and from the uncoupled position to the engagement position, which in particular enables a daily verification procedure for the operation of the mechanism, in the context of the start-up operations for the installation into which the cabin is integrated. The mechanism enables the motor to be uncoupled if a failure occurs in order to carry out certain troubleshooting operations and, where applicable, to return the cabin to an approximately horizontal position, by gravity.

According to one embodiment, the transmission joint comprises a double universal joint or a homokinetic joint. Preferably, it is ensured that in engagement position, a transmission joint entry element, driven by the motor shaft, is able to turn around an entry axis and a transmission joint exit element, attached to the sprocket, is able to turn around the drive axis, with the entry axis parallel to the drive axis and away from the drive axis.

The coupling mechanism guides the sprocket between the engagement position and the uncoupled position according to a preferably flat trajectory, which may be a sideways movement, a rotation or a combination of sideways movement and rotation. According to one embodiment, the coupling mechanism is able to guide a sprocket pivot movement around a pivoting axis parallel to the reference axis, between the engagement position and the uncoupled position, with the pivoting axis preferably attached in relation to the cabin. In particular, it may be specified that the coupling mechanism comprises a guide lever which pivots around the pivoting axis and which has a bearing to guide the sprocket in rotation around the drive axis.

Naturally, the coupling mechanism is intended to be motorized to enable automatic actuation following a command given from the cabin or remote from an installation control center.

According to one embodiment, the coupling mechanism comprises an actuator to move the sprocket from the engagement position to the uncoupled position. Preferably, the actuator is supplied by an autonomous power source embedded in the cabin, to respond to a risk of failure in the power transmission from the installation fixed to the cabin.

The actuator is preferably irreversible, in that if there is no power supply it remains blocked in position.

The coupling mechanism is preferably bistable, which prevents the actuator from being requested during transitional position change sequences.

According to one embodiment, the stabilization system comprises at least one additional sprocket, linked to the cabin so as to mesh with a corresponding gear ring constituted by the gear ring or by an additional gear ring attached to the support and centered on the reference axis, additional motorized drive resources able to drive the additional sprocket, comprising an additional motor with an additional motor shaft which turns round a fixed axis in relation to the cabin and an additional kinematic transmission chain between the additional motor shaft motor and the additional sprocket, as well as an additional coupling mechanism able to drive the additional sprocket between a meshing position with the corresponding gear ring, in which the additional sprocket is able to mesh with the corresponding gear ring, by turning around an additional drive axis parallel to the reference axis and an uncoupled position in which the additional sprocket is a distance away and disengaged from the corresponding gear ring, with the additional kinetic transmission chain comprising a transmission joint. Redundancy is then obtained for the stabilization functions. The presence of two mechanisms in particular enables control processing in degraded mode to be considered; these will be discussed further on in this document.

According to one embodiment, the corresponding gear ring comprises an additional gear ring centered on the reference axis and located axially at a distance from the gear ring.

For optimum use of the space, the motor and the additional motor are preferably placed head to tail, with the motor shaft and the additional motor shaft parallel but not coaxial.

The additional coupling mechanism preferably presents characteristics which are similar to the coupling mechanism.

According to one embodiment, the additional coupling mechanism guides the additional sprocket between the engagement position and the uncoupled position according to a preferably flat trajectory, preferably parallel to the sprocket's flat trajectory, and which may be a sideways movement, a rotation or a combination of sideways movement and rotation. According to one embodiment, the additional coupling mechanism supports the additional sprocket so that the additional sprocket is able to pivot around a second pivoting axis parallel to the reference axis, between the engagement position and the uncoupled position of the additional coupling mechanism, with the second pivoting axis preferably attached in relation to the cabin. In particular, it may be specified that the additional coupling mechanism comprises a guide lever which pivots around the second pivoting axis and which has a bearing to guide the additional sprocket in rotation around the second drive axis.

Preferably, the additional coupling mechanism comprises an additional actuator to move the additional sprocket from the engagement position to the uncoupled position, with the additional actuator preferably taking support on the cabin. The additional actuator may be of any type, notably electromechanical, hydraulic or pneumatic, and preferably telescopic.

According to one particularly advantageous embodiment, the additional coupling mechanism comprises a bistable transmission between the additional actuator and the additional sprocket, comprising preferably a transmission lever which pivots around an axis which is fixed in relation to the cabin, and a transmission link rod between the additional coupling mechanism transmission and the additional sprocket or the additional actuator.

In practice, the additional synchronous machine comprises a casing, which is either fixed in relation to the cabin or fixed in relation to the additional sprocket drive axis. A motor casing fixed in relation to the cabin minimizes the energy needed to move the mobile equipment consisting of the first sprocket. But it requires specific precautions to limit the transmission of vibrations or noise to the cabin. It also requires a transmission mechanism which is able to absorb the positioning variations between the motor casing and the first sprocket, for example a homokinetic joint or double universal joint transmission shaft linking the first motor to the first sprocket. A motor casing fixed in relation to the drive axis of the first sprocket enables a transmission mechanism which absorbs positioning variations to not be used, but where applicable does impose higher power from the first actuator. Motor here where applicable also means a geared motor.

Preferably, the additional coupling mechanism is independent of the coupling mechanism. This means that each of the two coupling mechanisms of the stabilization system is able to move the corresponding sprocket independently from the position of the other sprocket.

According to another aspect of the invention, this is linked to an attraction installation which comprises at least one fixed structure comprising at least one mobile subassembly as described above, driven and guided in relation to the fixed structure so that the mobile subassembly support follows a trajectory which forms a loop in a vertical plane of a fixed reference and, in relation to a fixed revolution axis perpendicular to the vertical plane and parallel to the reference axis, rotates 360° by traveling one turn of the loop trajectory.

According to one embodiment, the rotation axis is fixed and defined preferably by one or more guide bearings attached to the fixed structure. The rotation is preferably over more than one turn, notably for a "Ferris wheel" type attraction installation. The support may then be a carriage intended to be attached to a rim of the Ferris wheel, or a part of the rim itself, turning around the rotation axis.

According to another aspect of the invention, this is linked to a control process in degraded mode for an attraction installation as described above, characterized in that in response to a malfunction detection while the sprocket is meshing with the gear ring, a degraded operation procedure is initiated, comprising the following successive operations:

- a stoppage of the support in relation to the fixed structure;
- an application of the friction brake;
- using the winding switching circuit, connection of the windings of the synchronous machine to the ohmic circuit; then
- an at least partial, and preferably total, release of the friction brake, while the sprocket meshes with the gear ring, with the cabin brought by gravity to a stable position in relation to the support.

This first degraded operation procedure enables a stable gravity position to be restored, which depends naturally on the position of the passengers in the cabin, but may be close to horizontal, while the electricity power supply of the first synchronous machine is deficient.

In the case of a cabin for which the stabilization system comprises two motorized sprockets, this first degraded operation procedure will be implemented if the two synchronous machines lose their electricity power supply. The procedure may be implemented only on the first sprocket and the first synchronous machine, or simultaneously on the two sprockets and the two synchronous machines.

Preferably, the degraded operation procedure comprises in addition, after the cabin is stopped in stable position, a restart of the support drive in relation to the fixed structure. The support drive is restarted preferably at reduced speed, and with constant monitoring of the cabin's tilt. It enables the cabin to return to the landing platform, preserving its horizontal level relative to gravity.

According to a first variant, the degraded operating procedure also comprises, after the cabin is stopped in stable position, and before the support drive restarts in relation to the fixed structure, a movement of the sprocket from the engagement position with the gear ring to the uncoupled position in which the sprocket is a distance away and disengaged from the gear ring. The cabin adapts its position by gravity, with the rubbing on the cabin's guide bearings in relation to the support guaranteeing the stabilization of the cabin.

According to a second variant, the sprocket continues to mesh with the gear ring and the windings of the synchronous machine remain connected to the ohmic circuit after the support drive restarts in relation to the fixed structure. The synchronous machine continues to operate in electromagnetic brake.

According to one embodiment, it is also provided for that the degraded operating procedure is interrupted and a second degraded operation procedure is initiated if a malfunction condition of the degraded operation procedure is detected, with the second degraded operation procedure comprising the following operations:

- a stoppage of the support in relation to the fixed structure;
- a movement of the sprocket from the uncoupled position to the engagement position with the gear ring,
- an application of the brake, then
- a restart of the support drive in relation to the fixed structure.

The second degraded operation procedure may be initiated notably if the position reached by the cabin before the support restarts is outside an acceptable range, or if, after the support restarts, the cabin's tilt is not maintained within an acceptable range.

The second degraded operation procedure enables any movement of the cabin in relation to the support to be stopped. It will then be possible to take the support to the landing platform at very low speed. In that the cabin remains attached to the support during this journey, no tilt compensation is made, which may be quite uncomfortable for the passengers. This is why this second degraded operation procedure is reserved for exceptional situations, in which the first degraded operation procedure has failed.

BRIEF DESCRIPTION OF THE FIGURES

Other characteristics and advantages of the invention will arise from reading the following description, with reference to the annexed figures.

For more clarity, the identical or similar elements are marked by identical reference symbols on all the figures.

DETAILED DESCRIPTION OF THE EMBODIMENTS

Figure 1:
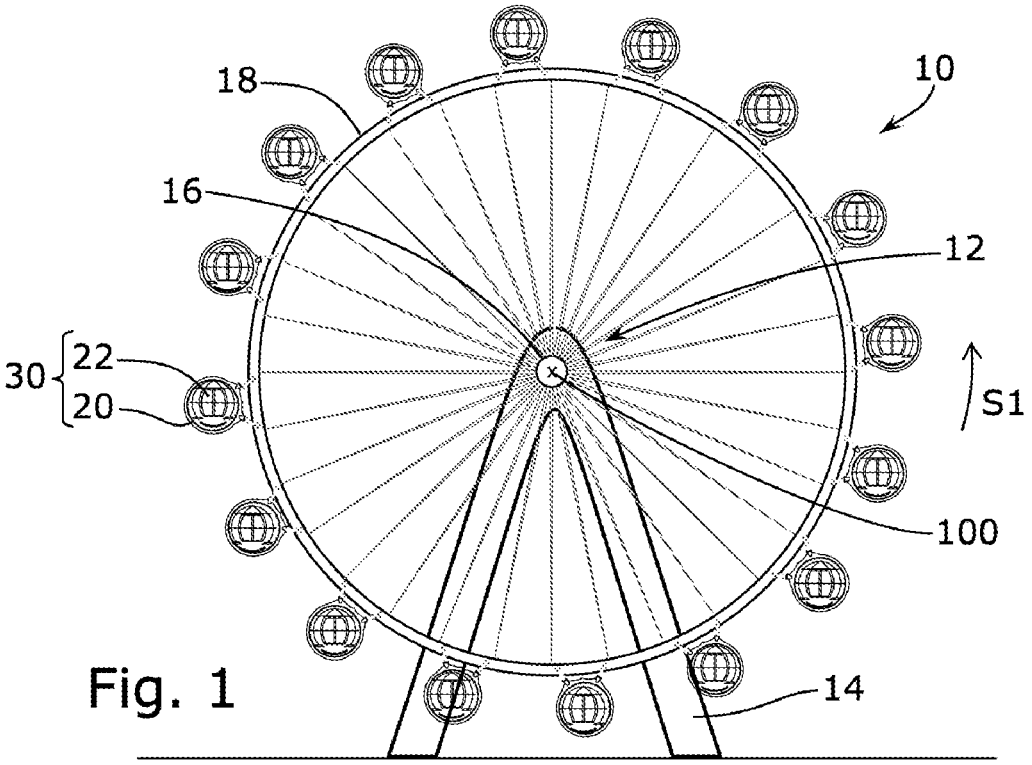
FIG. 1 illustrates a partial view of an attraction installation in accordance with the invention.

FIG. 1 illustrates a Ferris 10 installation with a horizontal revolution axis 100, comprising a fixed structure 12 mounted on the ground via one or more feet 14, with this fixed structure 12 forming a guide bearing 16 for a wheel rim 18 in rotation around a revolution axis 100 fixed in relation to the ground 14. The rim is provided at its edge of supports 20 of cabins 22. The revolution axis 100 constitutes preferably a revolution symmetry axis of N for the rim, where N is the number of supports 20 and cabins 22.

Figure 2:
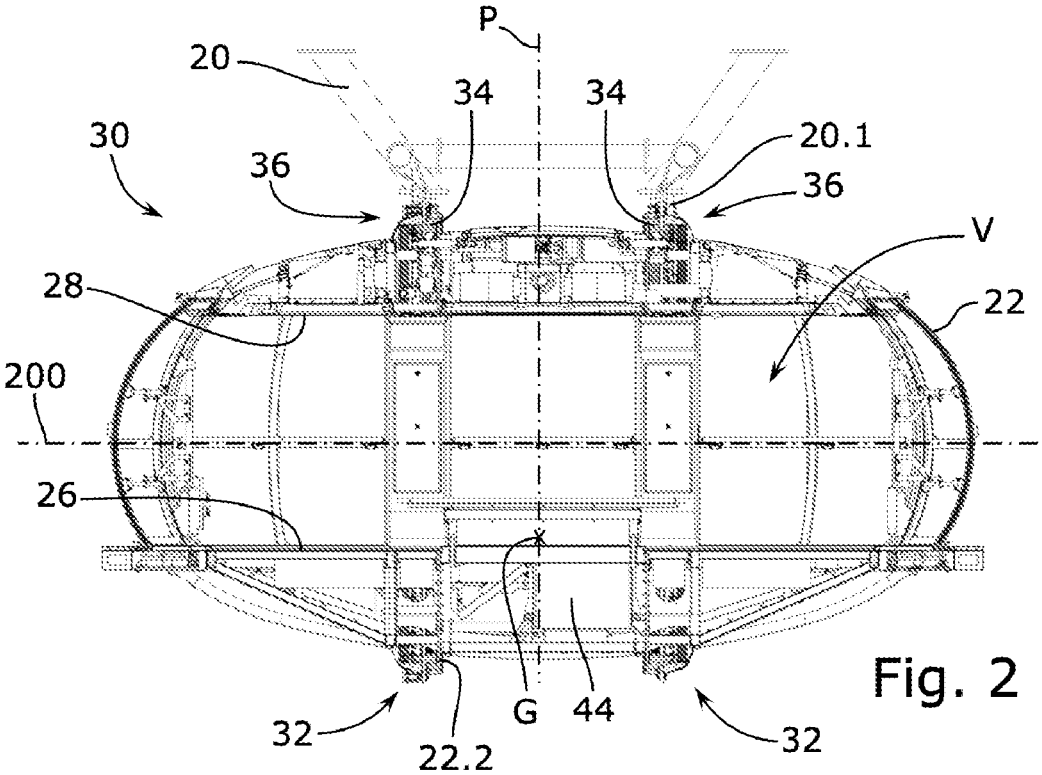
FIG. 2 is an axial cross sectional view of a mobile subassembly of the installation in FIG. 1.
Figure 3:
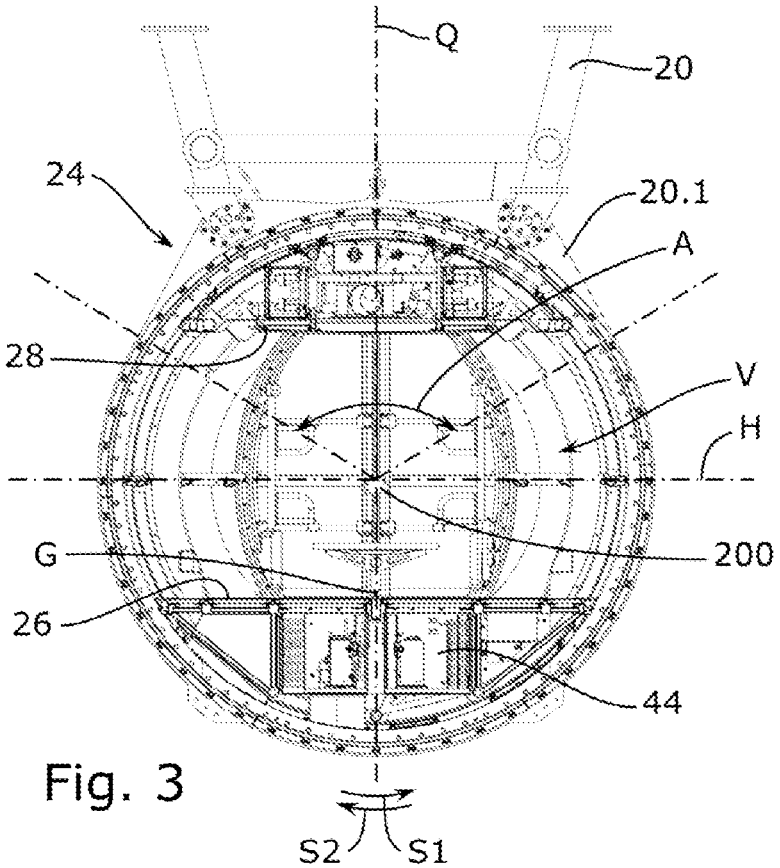
FIG. 3 is a transverse cross sectional view of the mobile subassembly in FIG. 2.
Figure 4:
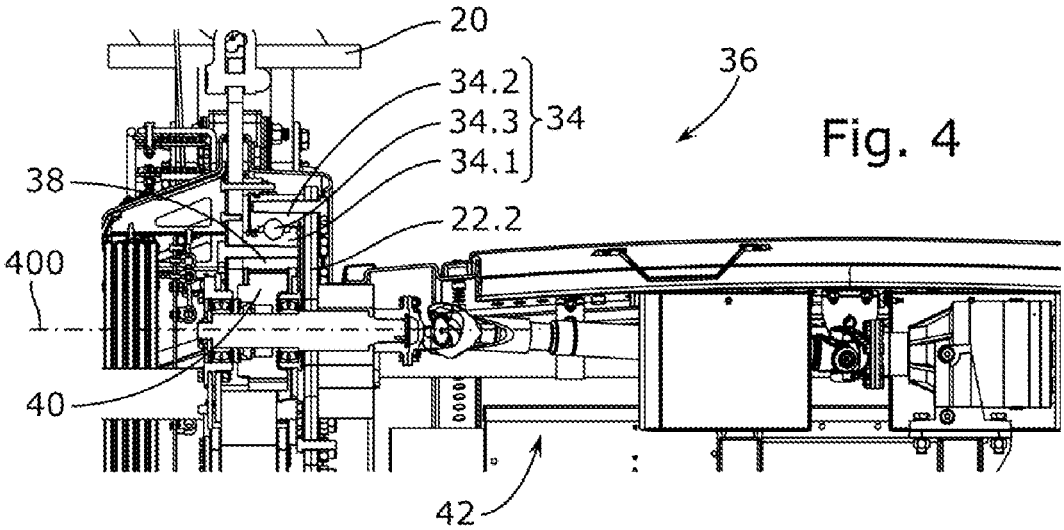
FIG. 4 is a detail of FIG. 3, illustrating in particular the implantation of a stabilization system of the mobile subassembly in FIG. 2.

As illustrated in FIGS. 2 and 3, each cabin 22 presents an interior volume V to receive and convey one or more passengers, marked out between a cabin floor 26 and a cabin ceiling 28. The support 20 and the associated cabin 22 then form a mobile subassembly 30 to receive and convey one or more passengers. This mobile subassembly 30 comprises in addition a guide 32 for the cabin 22 in relation to the support 20 in rotation around a reference axis 200 common to the support 20 and the cabin 22, horizontal and parallel to the revolution axis 100.

The guide 32 is constituted here of two coaxial bearings 34 distant from each other, so that the center of gravity of the cabin 22 is between two transverse vertical planes perpendicular to the reference axis 200, each cutting one of the two bearings 34. Preferably, the two bearings 34 are located in mirror position to each other in relation to a median transverse vertical plane P of the cabin 22, perpendicular to the reference axis 200 and containing the unloaded center of gravity G of the cabin 22. Each bearing 34 comprises at least a first bearing ring, for example an interior ring 34.1, attached to a ring 20.1 on the support 20, at least a second bearing ring, for example an exterior ring 34.2, attached to a ring 22.2 on the cabin 22, and one or more rows of bearing bodies 34.3 able to run on tracks formed on the first bearing ring 34.1 and the second bearing ring 34.2. Each of the two bearings 34 surrounds the interior volume V so that a part of each bearing 34 is under the floor 26, and another above the ceiling 28.

The guide 32 enables the cabin floor 26 to be maintained horizontal by authorizing the rotation of the support 20 around the revolution axis 100 of the Ferris wheel 10 in a direction S1 with the rotation of the cabin 22 in relation to the support 20 around the reference axis 200 in the opposite direction S2.

To synchronize these rotations, the mobile subassembly 30 is equipped with a stabilization system 36. This stabilization system 36 is duplicated here and comprises two gear rings 38 attached to the rings 20.1 of the support 20 and centered on the reference axis 200, positioned preferably each near one of the bearings 34. Each of the gear rings 38 is associated with a sprocket 40, mounted on the cabin 22 so as to mesh with the associated gear ring 38. Each sprocket 42 is associated with drive resources 42.

Each sprocket 40, driven by motorized drive resources 42, meshes with the associated gear ring 38 attached to the support 20, to maintain the floor 26 of the cabin 22 horizontal.

In this embodiment, each gear ring 38 has teeth 38.1 turned radially towards the interior, and the associated sprocket 40 is located above the ceiling 28 of the interior space V of the cabin 22, held with a teeth zone 38.1 also located above the interior ceiling 28 of the cabin 22 and the associated sprocket 40. This positioning prevents a foreign object, which falls onto the teeth 38.1 in the part of the teeth 38.1 located under the horizontal plane H containing the reference axis 200, from traveling to the sprocket 40 and blocking it.

Figure 5:
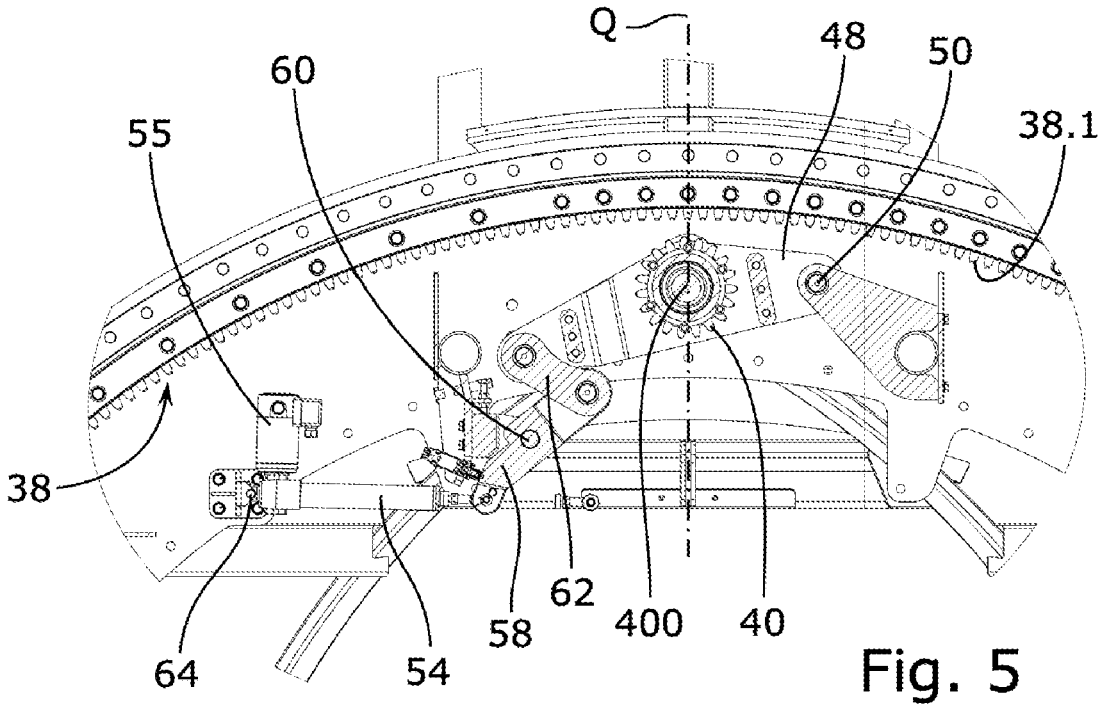
FIG. 5 is a front view of the stabilization system in FIG. 4, in an uncoupled position.
Figure 6:
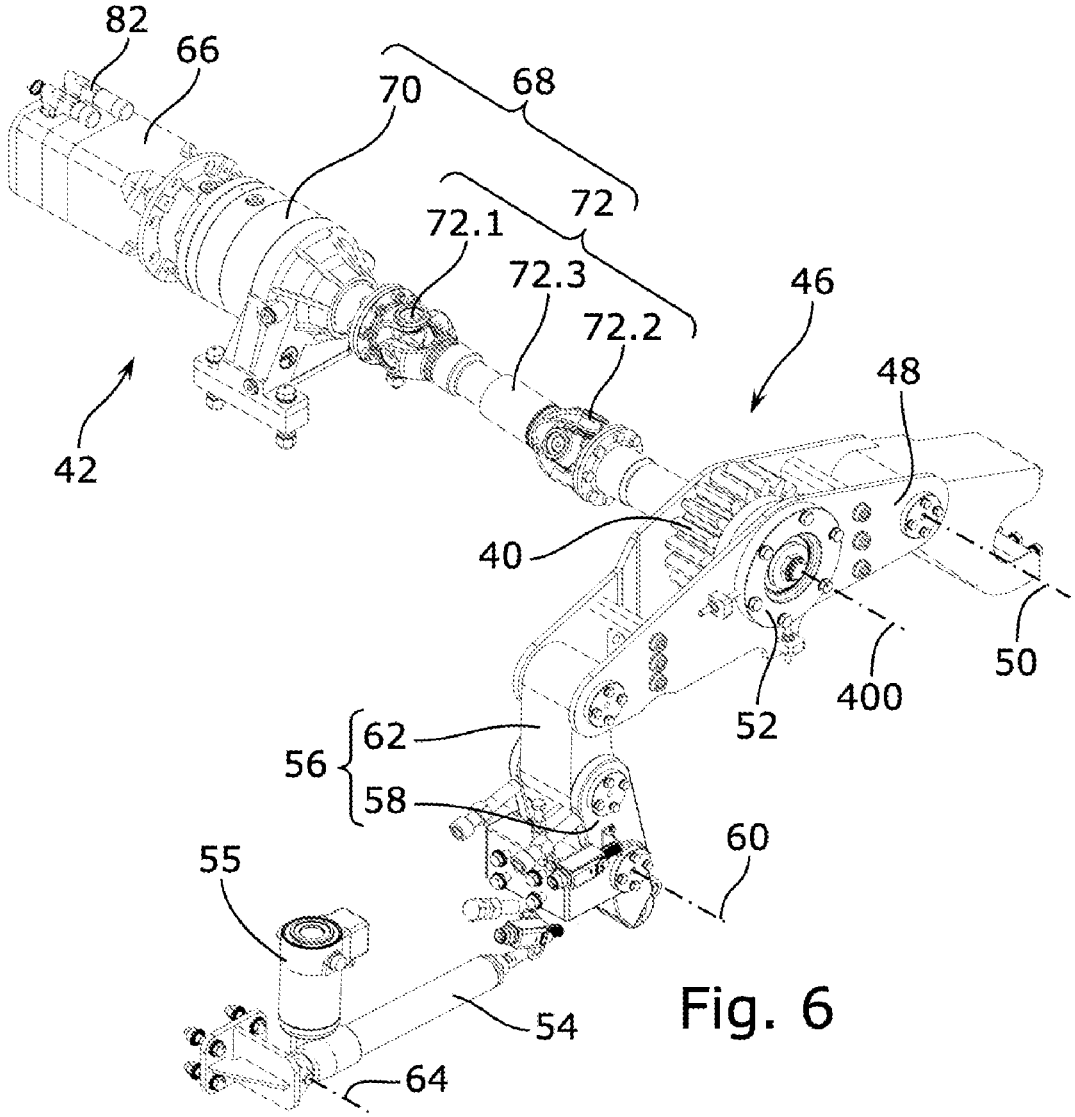
FIG. 6 is an isometric view of the mobile subassembly in FIG. 4.

The rotation axes 400 of the sprockets 40 are positioned preferably near the reference axial plane Q, either directly in the reference axial plane Q, as illustrated in FIG. 5 or on one side of the reference axial plane Q, within an angular sector A less than or equal to ±60° in relation to the reference axial plane, around the reference axis.

Figure 7:
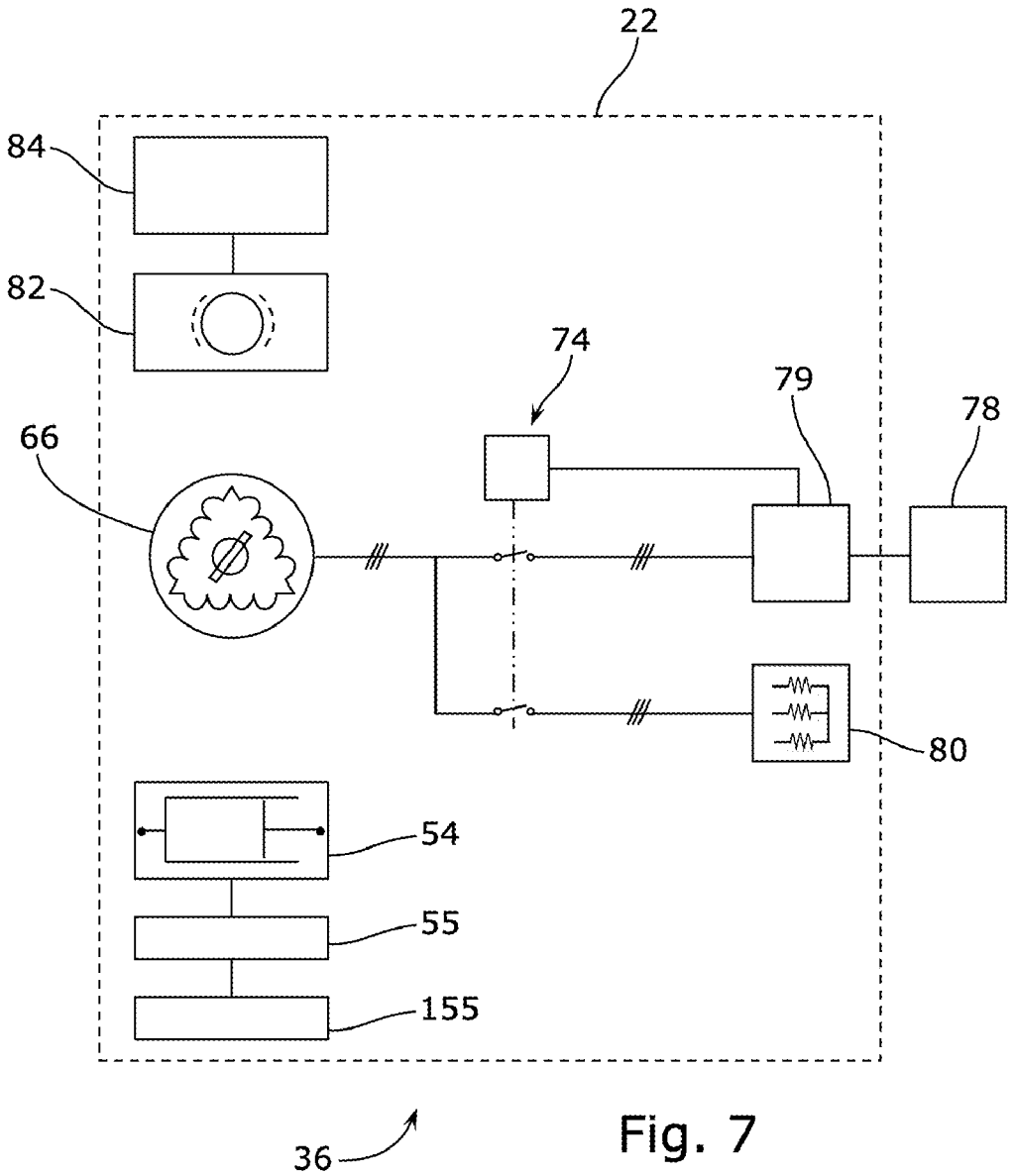
FIG. 7 illustrates an electrical diagram for a switching circuit of a synchronous machine of the stabilization system.
Figure 8:
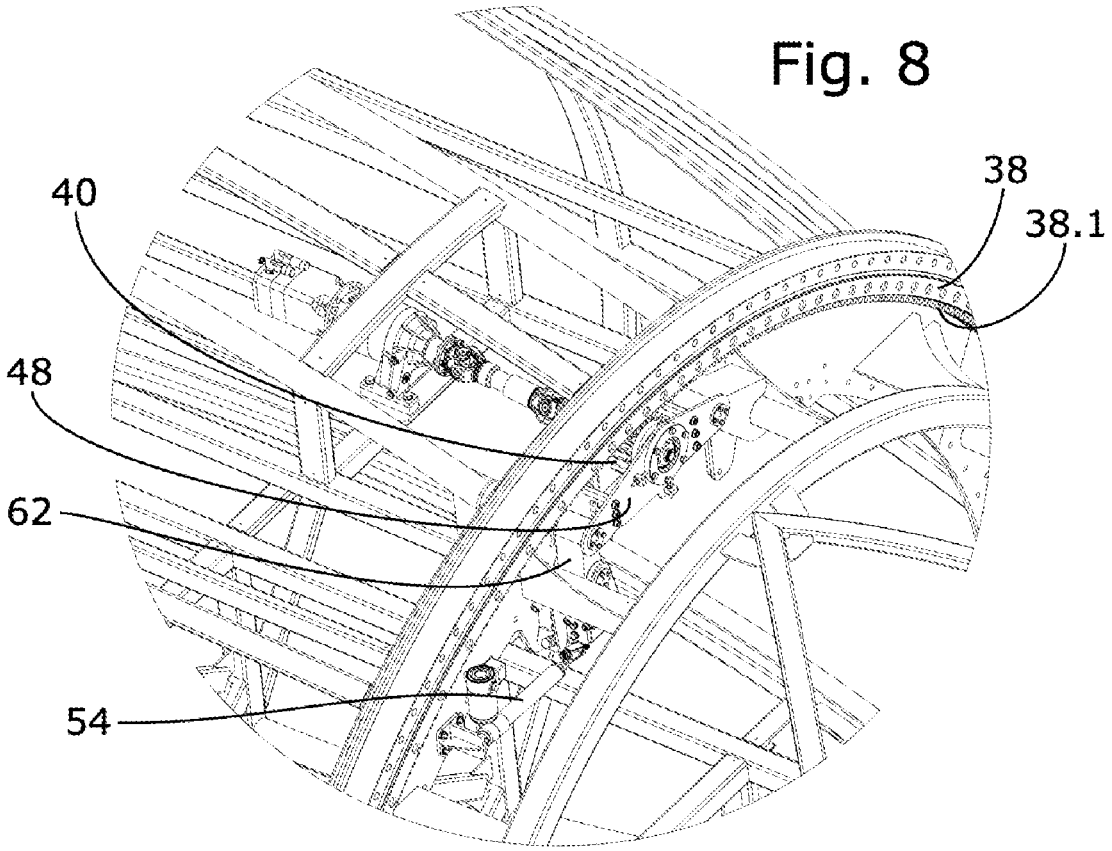
FIG. 8 is an isometric detail view of the integration of the stabilization system in FIG. 4, in a mobile subassembly in FIG. 2, in an engaged position.
Figure 9:
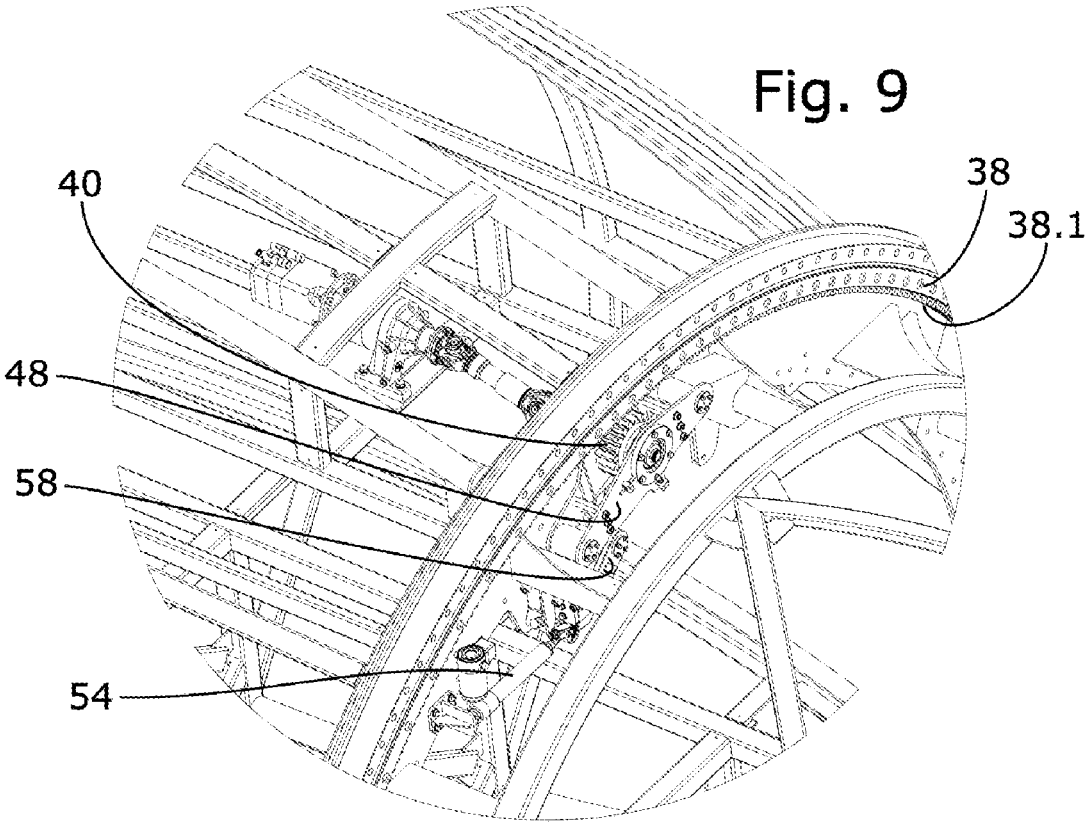
FIG. 9 is an isometric detail view of the integration of the stabilization system in FIG. 4, in the mobile subassembly in FIG. 2, in an uncoupled position.

Each sprocket 40 is linked to the cabin 22 by a coupling mechanism 46, illustrated in detail in FIG. 8, to guide the sprocket 40 between an engagement position with the associated gear ring 38 and a disengaged position. In engaged position, as illustrated in FIG. 7, the sprocket 40 meshes with the associated gear ring 38 while in disengaged position, illustrated in FIGS. 5 and 9, the sprocket 40 is a distance away from the associated gear ring 38.

Each coupling mechanism 46 comprises a guide lever 48 which pivots around a pivoting axis 50 which is fixed in relation to the cabin structure 22. The guide lever 48 carried a guide bearing 52 for the associated sprocket 40 in rotation around a drive axis 400.

An actuator 54, coupled to a motor 55, is used to pivot the guide lever 48, via a bistable transmission 56. In this embodiment, the bistable transmission 56 comprises a transmission lever 58 which pivots around an axis 60 which is fixed in relation to the cabin 22 and parallel to the reference axis 200, and a transmission link rod 62 between the transmission lever and the guide lever 48. A first end of the actuator 54 is mounted pivoting in relation to an axis 64 which is fixed in relation to the cabin 22 and an opposite end of the actuator 54 is articulated on the transmission lever 58. The subassembly constituted by the actuator 55 and its motorization system 55 is preferably irreversible in that it is not necessary to maintain a power supply to maintain it in a given position. This may be the case in particular if the actuator is constituted of an irreversible captive screw. The motor 55 is preferably an electric motor. Of course, the skilled person is able to propose numerous variants for this system, which conserve its functions. As the articulation and pivoting axes are parallel to the reference axis 200, the movement of the whole of each coupling mechanism 46 is a flat movement to guide a pivoting of the rotation axis 400 of the associated sprocket 40 around the pivoting axis 50, between the engagement position and the uncoupled position.

The motorized drive resources 42 associated with each sprocket 40 comprise a reversible permanent magnet synchronous machine 66 for which the motor shaft, via a kinematic chain 68 comprising a reducer 70 and a homokinetic joint 72 drive the associated sprocket 40 in rotation. In this embodiment, the casing of the synchronous machine 66 is attached in relation to the cabin 22. The homokinetic joint 72 is produced here as standard by two universal joints 72.1, 72.2 linked by a shaft 72.3 to accommodate the movements of the sprocket 40 induced by the coupling mechanism 46.

A power switching circuit 74, illustrated in a diagram in FIG. 7, is used, in a first switching state, to link the stator windings 76 of the synchronous machine 66 to an electricity power supply 78 outside the cabin 22 via a power command 79, for motor use of the first synchronous machine 66. The switching circuit 74 is also used, in a second switching state, to link the stator windings 76 of the synchronous machine 66 to a dissipative ohmic circuit 80 for dissipative use of the synchronous machine 66.

The power switching circuit 74 is preferably monostable, in that it requires an electricity supply from the electricity power supply 78 or the power command 79 to maintain itself in the first state, and that if there is no electricity supply it switches itself to the second state. The switching circuit 74 may notably comprise a monostable electromechanical contact or a monostable static contact.

Finally, an electromechanically or hydraulically commanded friction brake 82 is positioned either directly on the motor shaft of the synchronous machine 66 or in the kinematic chain between the synchronous machine 66 and the sprocket 40, or on the gear ring 38. The friction brake 82 is preferably monostable, normally closed, and is activated by an embedded autonomous power source 84, which may, where applicable, also power the motor 55 of the actuator 54. Alternatively, the actuator motor 55 may be provided with a distinct embedded autonomous electricity power supply 155.

Preferably, the supply and command circuits for the two parallel branches of the stabilization system 36 are independent.

To maintain the floor 26 of the cabin 22 horizontal, the motorized drive resources 42 which may be controlled by the angular position of the wheel rim 12 around the revolution axis 100 of the Ferris wheel 10, for example by comparing a measurement of the angular position of the cabin around the revolution axis and a measurement of the angular position of the cabin in relation to the support. To this end, one of the bearings 34 may be instrumented to deliver a measurement of this angular position. Alternatively, the motorized drive resources 42 may be controlled by an inclinometer positioned in the cabin 22. Other physical scales may also be taken into account to command the motorized drive resources 42, notably the cabin load 22, the position of the loaded cabin's center of gravity 22 or the wind speed and direction, as well as the data from the previous cabin 22 in the Ferris wheel's 10 movement direction.

The power needed is lower the closer the loaded cabin's center of gravity 22 is to a reference axial plane Q of the cabin 22, perpendicular to the floor 26 and containing the reference axis 200. In practice, the loaded cabin's center of gravity 22 is below a horizontal plane H containing the reference axis 200, between the reference axis 200 and the floor 26, or below the floor 26, which enables a degraded operating mode to be considered, in which, in the event of a malfunction of the motorized drive resources 42, the gravity effect enables the floor 26 to be held more or less horizontal. To this end, the space located under the floor is occupied by a cooling, heating or air conditioning unit 44 of the cabin 22, for which the weight contributes to lowering the cabin's center of gravity 22.

The redundancy of the two branches of the stabilization system 36 increases the installation's availability. If there is no failure, the two motors operate in master-slave mode.

When a motor 42 is defective, the associated sprocket 40 is uncoupled and the other motor 42 positions the cabin 22 on its own. In a similar way, if a foreign body positions itself between one of the sprockets 40 and the associated teeth 38.1, despite the positioning of the sprocket 40 below the teeth 38.1, the coupling mechanism 46 enables the sprocket involved 40 to be disengaged, and the other sprocket 40 positions the cabin 22 on its own.

A failure diagnostic procedure may also be provided for if a malfunction is observed on the stabilization system, leading to the cabin floor tilting beyond a predetermined threshold. Proceed as follows in this case:

- first of all, stop the wheel rim 18 to stop the support 20 in relation to the fixed structure 12;
- cut the electricity power supply 78 of the two synchronous machines 66;
- when stopped, apply the two friction brakes 82;
- uncouple one of the two sprockets 40 from the associated gear ring 38;
- power the synchronous machine 66 linked to the other sprocket 40 so as to re-establish the stabilization command and check whether the cabin 22 returns to horizontal;
- if it does, restart the Ferris wheel 10;
- otherwise, recouple the sprocket 40 which was uncoupled and uncouple the sprocket 40 which was coupled
- power the synchronous machine 66 linked to the coupled sprocket 40 so as to re-establish the stabilization command and check whether the cabin 22 returns to horizontal;
- if it does, restart the Ferris wheel 10;
- otherwise, the failure encountered is affecting the two branches of the stabilization system 36 and requires the implementation of a degraded operating procedure.

To this end, if the power supply 78 of the two asynchronous machines 66 fails, a "gravity" degraded operation procedure is implemented, comprising the following steps:

- first of all, stop the wheel rim 18 to stop the support 20 in relation to the fixed structure 12;
- when stopped, apply the two friction brakes 82;
- using the switching circuits 74, connect the windings 76 of each of the two synchronous machines 66 to the associated ohmic circuit 80; then
- release at least partially the friction brake 82, while the first sprocket 40 meshes with the first gear ring 38, with the cabin 22 brought by gravity to a stable position in relation to the support 20.

The cabin 22 then starts moving under the effect of gravity, so as to align its center of gravity in a vertical plane containing the reference axis 200. In this phase, the two synchronous machines 66 constitute electromagnetic brakes, generating a braking torque proportional to the rotating speed of the cabin 22.

This procedure is implemented preferably under the supervision of the installation's personnel, who are linked by audio or video to the passengers in the cabin 22, following a malfunction signal, which may be a diagnostic signal from the synchronous machines' electricity supply or a signal relative to the horizontal level of the cabin floor 22. Where applicable, the passengers may be given instructions to redistribute the load within the cabin 22 so that the stable position of the cabin corresponds to a horizontal position of the floor 26.

Once the cabin 22 has stopped in a stable position, the Ferris wheel 10 may be restarted, at reduced speed, to take the defective cabin to the loading and landing area. During this Ferris wheel movement phase, various strategies are possible to try to preserve a relative horizontal level for the floor 26 of the cabin 22. A first strategy consists in conserving the sprockets 40 which are held with the gear rings 38, and the synchronous machines 66 in electromagnetic braking mode, to absorb the movements of the cabin 22 in this phase. A second strategy consists in disengaging the sprockets 40 before restarting the Ferris wheel 10.

If the gravity degraded operating mode does not enable the position sought for the cabin 22 to be found, a subsidiary degraded operating mode is provided, which consists in reengaging the sprockets 40 with the associated gear rings 38, then applying the friction brakes 82 to connect the cabin 22 to the support 20, before restarting the Ferris wheel 10. This operating mode, which is much less comfortable than the previous one, modifies the orientation of the floor 26 as the Ferris wheel rotates. Communication is therefore required with the passengers in the cabin throughout the operation, which must be carried out at very low speed.

Note that the gravity degraded operating mode and the subsidiary degraded operating mode may also be considered with a single synchronous machine 66 and a single sprocket 40.

Naturally, the examples shown in the figures and discussed above are provided for information purposes only and are not limiting. It is explicitly provided for that the different embodiments illustrated may be combined to propose others.

According to a simplified embodiment, the stabilization system 24 may only feature a single gear ring 38 associated with a single sprocket 40. The ring is then positioned preferably near a transverse plane containing the center of gravity of the unloaded cabin 22. If the guide 32 comprises two bearings 34, the single gear ring 38 is preferably positioned axially between the two bearings 34.

The ring of each bearing attached to the cabin 22 may be the interior ring 34.1 or the exterior ring 34.2.

The sprocket 40 rotation axis is preferably parallel to the reference axis 200, although a different orientation is also possible if the meshing between the gear ring 38 and the sprocket 40 is angular gear.

The support is not necessarily a part of the rim 12 of a Ferris wheel 10. It may also be a mobile carriage on a guide track of a fixed structure of the type described in document EP 2 075 043, forming a closed loop, circular or not, in a vertical plane. In all the configurations considered, the movement of the support 20 in a loop translates to a rotation of the support 20 in relation to a fixed reference of one turn per loop turn traveled.

It is emphasized that all the characteristics, as they appear to a skilled person from this description, the drawings and attached claims, even if in concrete terms, have only been described in relation with other determined characteristics, both individually and in any combinations, may be combined with other characteristics or groups of characteristics disclosed here, if this has not been expressly excluded or if technical circumstances make these combinations impossible or meaningless.

The invention claimed is:

1. A mobile subassembly to receive and convey at least one passenger, comprising a support, a cabin and a cabin guide for guiding the cabin in relation to the support in rotation around a reference axis common to the support and the cabin, with the reference axis horizontal when the mobile subassembly is in an operational state, with the mobile subassembly equipped with at least one stabilization system comprising at least one gear ring connected to the support and centered on the reference axis, at least one sprocket linked to the cabin so as to mesh with the gear ring, a friction brake to stop the cabin rotating around the reference axis in relation to the support, and motorized drive resources which are able to drive the sprocket, wherein the motorized drive resources comprise a reversible permanent magnet synchronous machine and a switching circuit which is able, in a first switching state, to link windings of the synchronous machine to an electricity power supply for motor use of the synchronous machine and, in a second switching state, to link the windings of the synchronous machine to a dissipative ohmic circuit for dissipative use of the synchronous machine.

2. The mobile subassembly of claim 1, wherein the switching circuit is monostable and switches or remains in the second switching state if the electricity power supply is disconnected upstream of the switching circuit.

3. The mobile subassembly of claim 2, wherein the switching circuit comprises a monostable electromechanical contact or a monostable static contact.

4. The mobile subassembly of claim 1, wherein the friction brake is commanded in all or nothing.

5. The mobile subassembly of claim 1, wherein the friction brake is commanded by a monostable command.

6. The mobile subassembly of claim 5, wherein the monostable command of the friction brake comprises an autonomous power source embedded in the cabin.

7. The mobile subassembly of claim 1, wherein the sprocket is linked to the cabin by a coupling mechanism which is able to guide the sprocket between an engagement position with the gear ring, in which the sprocket is able to mesh with the gear ring by turning around a drive axis parallel to the reference axis and an uncoupled position in which the sprocket is a distance away and disengaged from the gear ring.

8. The mobile subassembly of claim 1, wherein the stabilization system comprises at least one additional sprocket linked to the cabin so as to mesh with a corresponding gear ring constituted by the gear ring or by an additional gear ring, attached to the support and centered on the reference axis additional motorized drive resources able to drive the additional sprocket, with the additional motorized drive resources comprising an additional reversible permanent magnet synchronous machine and an additional switching circuit which is able, in a first additional switching state, to link windings of the additional synchronous machine to an electricity power supply for motor use of the additional synchronous machine and, in a second additional switching state, to link the windings of the additional synchronous machine to a dissipative ohmic circuit for dissipative use of the additional synchronous machine.

9. An attraction installation which comprises at least one fixed structure comprising at least one mobile subassembly to receive and convey at least one passenger, the mobile subassembly comprising a support, a cabin and a cabin guide for guiding the cabin in relation to the support in rotation around a reference axis common to the support and the cabin, with the reference axis horizontal when the mobile subassembly is in an operational state, the attraction installation comprising a support drive for driving and guiding the mobile subassembly in relation to the fixed structure so that the mobile subassembly support follows a trajectory which forms a loop in a vertical plane of a fixed reference and rotates 360° in relation to a fixed revolution axis perpendicular to the vertical plane and parallel to the reference axis of the mobile subassembly, by traveling one turn of the loop trajectory, wherein the mobile subassembly is equipped with at least one stabilization system comprising at least one gear ring connected to the support and centered on the reference axis, at least one sprocket linked to the cabin so as to mesh with the gear ring, a friction brake to stop the cabin rotating around the reference axis in relation to the support, and motorized drive resources which are able to drive the sprocket, wherein the motorized drive resources comprise a reversible permanent magnet synchronous machine and a switching circuit which is able, in a first switching state, to link the windings of the synchronous machine to an electricity power supply for motor use of the synchronous machine and, in a second switching state, to link the windings of the synchronous machine to a dissipative ohmic circuit for dissipative use of the synchronous machine.

10. A control process in degraded mode for the attraction installation of claim 9, wherein in response to a malfunction detection while the sprocket is meshing with the gear ring, a degraded operation procedure is initiated, comprising the following successive operations:

the support is stopped in relation to the fixed structure;

the friction brake is applied;

the switching circuit is switched to connect the windings of the synchronous machine to the dissipative ohmic circuit; then the friction brake is at least partially, released while the sprocket meshes with the gear ring, so that the cabin is brought by gravity to a stable position in relation to the support.

11. The control process of claim 10, wherein the degraded operation procedure comprises, after the cabin has stopped in stable position, restarting the support.

12. The control process of claim 11, wherein the sprocket is linked to the cabin by a coupling mechanism which is able to guide the sprocket between an engagement position with the gear ring, in which the sprocket is able to mesh with the gear ring by turning around a drive axis parallel to the reference axis, and an uncoupled position in which the sprocket is a distance away and disengaged from the gear ring and the degraded operating procedure also comprises, after the cabin has stopped in the stable position, and before the support drive restarts in relation to the fixed structure, a movement of the sprocket from the engagement position with the gear ring to the uncoupled position in which the sprocket is a distance away and disengaged from the gear ring.

13. The control process of claim 12, wherein the sprocket continues to mesh with the gear ring and the windings of the synchronous machine remain connected to the dissipative ohmic circuit after the support drive has restarted.

14. The control process of any of claim 10, wherein the degraded operating procedure is interrupted and a subsidiary degraded operation procedure is initiated when a malfunction condition of the degraded operation procedure is detected, with the subsidiary degraded operation procedure comprising the following operations:

the support is stopped in relation to the fixed structure;

the sprocket is moved from the uncoupled position to the engagement position with the gear ring, the brake is applied, then the support drive is restarted.

* * * * *